US005605331A

United States Patent [19]

Boe

[11] Patent Number: 5,605,331

[45] Date of Patent: Feb. 25, 1997

[54] DICE GAME AND BOARD

[76] Inventor: Marvin Boe, 3402 Ivy, Rapid City, S. Dak. 57701

[21] Appl. No.: 669,142

[22] Filed: Jun. 24, 1996

[51] Int. Cl.[6] ..... A63F 9/04

[52] U.S. Cl. ..... 273/146; 273/268

[58] Field of Search ..... 273/268, 138 R, 273/139, 146

[56] References Cited

U.S. PATENT DOCUMENTS

| | | | |
|---|---|---|---|
| 1,238,522 | 8/1917 | Kalista | 273/268 X |
| 4,469,329 | 9/1984 | Guyer | 273/146 |
| 4,711,453 | 12/1987 | Saint Ive | 273/268 |
| 4,834,386 | 5/1989 | Rosenthal et al. | 273/146 |
| 4,893,816 | 1/1990 | Levy et al. | 273/146 |
| 4,930,780 | 6/1990 | Goodman et al. | 273/146 |
| 5,301,952 | 4/1994 | Fitzgerald | 273/269 |
| 5,405,145 | 4/1995 | Jones et al. | 273/268 X |
| 5,456,467 | 10/1995 | Hoover | 273/146 |

FOREIGN PATENT DOCUMENTS

| | | | |
|---|---|---|---|
| 0442132 | 8/1991 | European Pat. Off. | 273/268 |
| 2557804 | 7/1985 | France | 273/268 |

*Primary Examiner*—William E. Stoll
*Attorney, Agent, or Firm*—Gene R. Woodle

[57] ABSTRACT

A dice game and board are disclosed and a lead player is determined. The lead player and all succeeding players each have a turn in each round of play. The lead player rolls eight dice in an attempt to get the greatest number of either 6's, 5's, 4's, 3's, 2's, or 1's. In any turn the lead player may roll up to five of the dice twice after the initial roll in an effort to add to the number of 6's, 5's, 4's, 3's, 2's, or 1's rolled in the first roll. A predetermined value is assigned to the result of the lead player's turn. This value may be indicated upon the game board by placing a colored marker peg at the appropriate value on the game board. Subsequent players attempt to achieve a result of a higher predetermined value than that achieved by the lead player in the same number of rolls used by the lead player. If one or more subsequent players achieve a result higher than that of the lead player, the subsequent player with the highest result becomes the lead player and begins a new round of play. The lead player's score in any round is determined by moving the lead player's colored marker to the appropriate position on the game board.

7 Claims, 1 Drawing Sheet

DICE GAME AND BOARD

BACKGROUND OF THE INVENTION

1. Field of the Invention

The present invention relates generally to games and more particularly to games in which players throw multiple dice and receive scores bases upon the dice thrown.

2. Background Information

A great number of games have been invented and played throughout history for the purposes of entertainment and education. Many games involve the use by players of standard dice which are cubes having the number one through six represented upon the six sides. Most of these games include a method of scoring based upon the results of each player throwing various combinations of a number of dice. In many instances a board or other apparatus is provided to assist in or provide a method for keeping score.

Dice throwing games are widely known in the prior art and include a variety of combinations of rules, scoring, and game apparatuses. Several dice throwing games and apparatuses have been patented. The patent issued to Fitzgerald (U.S. Pat. No. 5,301,952; Apr. 12, 1994) provides an example a game apparatus for a dice throwing game. The apparatus consists of six numbered rows and six numbered columns with the intersection of each row and column marked with a score. Each player rolls two standard dice and places a marker at either of two intersections of rows and columns represented by the number on each of the two dice. The object of the game is to complete any combination of 3 rows, columns, or diagonals of six markers in a line.

The patent issued to Goodman et al. (U.S. Pat. No. 4,930,780; Jun. 5, 1990) discloses a dice box having two sections, a throwing section and a holding section. Players in turn roll six dice into the throwing section. Various scores have been assigned to various combinations of dice and some single dice and players move scoring dice from the throwing section to the holding section. Players may then reroll the dice remaining in the throwing section in an attempt to roll more scoring combinations or pass the turn to the next player. If a player chooses to throw the remaining dice and does not roll any scoring combinations, scores previously attained in the same turn are forfeited.

The patent issued to Saint Ive (U.S. Pat. No. 4,711,453; Dec. 8, 1987) discloses a game apparatus for a dice throwing game having a triangular shape. The triangle is made of six rows of places with the bottom row having six places, the next row having five places, and so on until the top row which has only one place. Each row and diagonal column is numbered from one through 6 starting at the bottom left corner of the triangle. Players roll two dice and place a marker on the apparatus at the place represented by the numbers on the two dice. The object of the game is to completely fill any of the various rows or diagonal columns of the triangle with a line of markers.

The instant invention is a dice game and board which is unique, original, and fills the need for a new and improved dice game and board which provides for improved entertainment, application of skill, and strategy.

The ideal dice game and board provides a game which is simple to learn, is entertaining, and provides an opportunity to apply skill and strategy. The ideal dice game and board should also be simple to play, lightweight, compact, easy to use, and inexpensive.

SUMMARY OF THE INVENTION

The present invention provides a dice game and board which is easy to learn and entertaining to play. The game includes eight standard dice, a dice cup, a plurality of variously colored marker pegs, and the game board. The score portion of the game board includes eight rows and eight columns of scores which increase from left to right and from top to bottom. Each column is marked with Roman numerals from I to VIII and each row is marked with letters from A to H. A score hole for a marker peg is also provided above each column. The results portion of the game board includes five columns of numbers. Each column of numbers is marked by a representation of a different face of a standard die starting with a six on the left and, going in descending order, ending with a two on the right. The rows include the numbers two through eight under the six, three through eight under the five, four through eight under the four, five through twelve under the three, and six through twelve under the two. A results hole for a marker peg is also provided beside each row.

The game may be played by individual players or teams of players and each player or team receives a different colored marker peg. Players select a lead player or each roll a die to determine the lead player. The lead player rolls all eight dice using the dice cup. If a player rolls one or more 1's they are wild and may be used to represent either a 2, 3, 4, 5, or a 6 and all other dice count at face value. Wild 1's must be paired with another die to be counted and a wild 1 used with either 2's or 3's count double or as two 2's or 3's. The lead player may roll one, two, or three times and may reroll up to five of the eight dice. At any time during his turn, the lead player may declare 4's, in which case only 4's may be used for scoring by the lead player and all subsequent players. The lead player's score is determined by referring to the results portion of the game board and the lead player generally attempts to attain the largest number of either 6's, 5's, 4's, 3's, or 2's counting wild 1's in the fewest number of rolls. The lead player places his colored marker peg in the results hole corresponding to the results of his turn. If a wild 1 is used with either 2's or 3's they count double; that is, if five 2's and two 1's were rolled, the roll would be scored as nine 2's and the marker peg would be placed in the results hole beside the D. Succeeding players then in turn roll the same number of times as the lead player and attempt to obtain a higher result than the lead player. A higher result is obtained by achieving a result which is further down the results portion of the game board than the lead player. Each player who achieves a result higher than a previous player places his colored marker peg in the appropriate results hole. If no succeeding player achieves a result higher than the lead player's, the lead player remains the lead player; otherwise the succeeding player achieving the highest result becomes the lead player.

At the start of the game a white peg is placed in the score hole beneath the I. If the lead player achieves the highest result in a round, the white peg is moved one hole to the right; that is, under the II and the lead player receives the score relating to the score indicated at the intersection of the column in the scoring portion marked by the white peg and the row marked by the lead player's colored marker peg. If a succeeding player has become the lead player the white peg is moved back one column or remains in column I if it was already in that column and the new lead player starts a new round of play.

The winner of the game is the first player to achieve some predetermined total score established by the players at the start of the game.

One of the major objects of the present invention is to provide a game which is simple to learn, is entertaining, and provides an opportunity to apply skill and strategy.

Another objective of the present invention is to provide a game which is simple to play, lightweight, compact, easy to use, and inexpensive.

These and other features of the invention will become apparent when taken in consideration with the following detailed description and the drawings.

DESCRIPTION OF A PREFERRED EMBODIMENT

Figure 1:
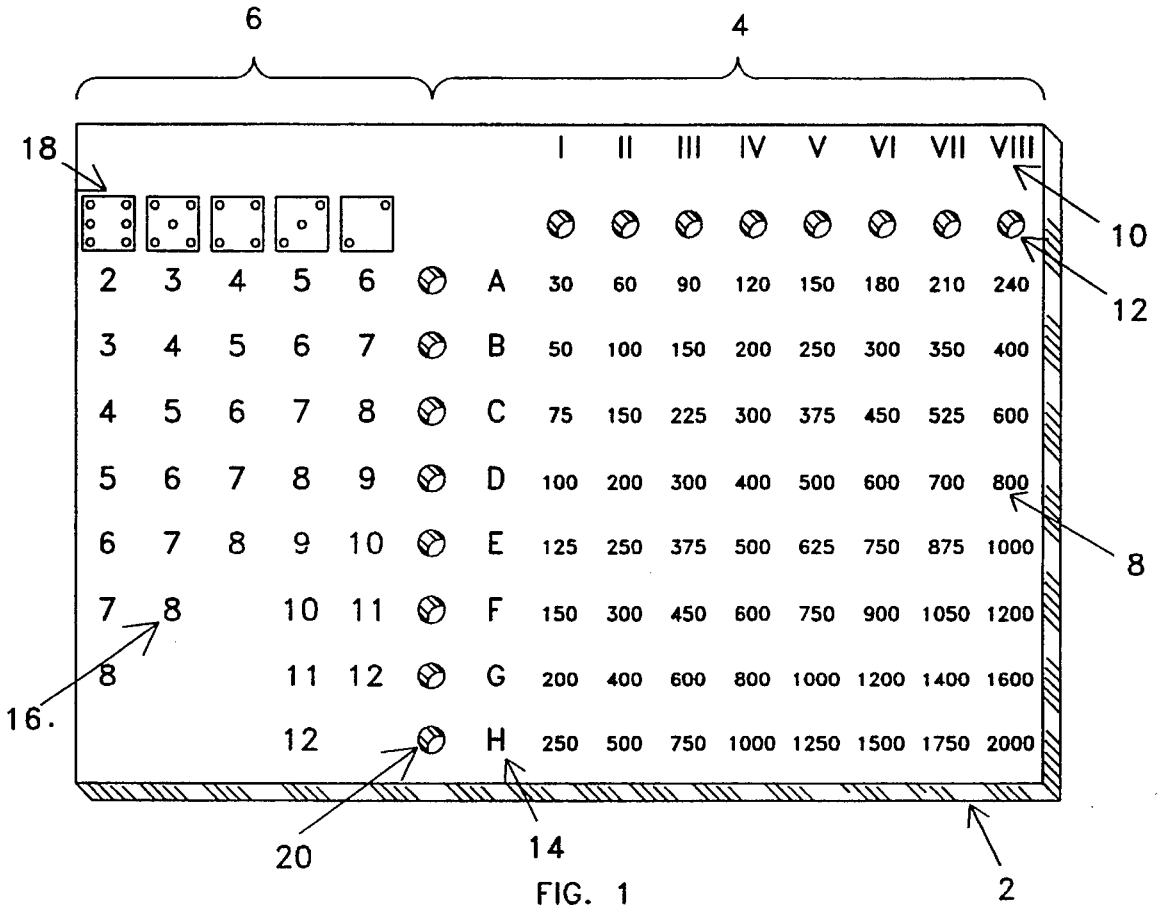
FIG. 1 is a perspective view of a preferred form of a game board portion of the dice game and board of the present invention.

Referring to the drawings, FIGS. 1 through 4, there is shown a preferred form of the dice game and board embodying the present invention.

Referring to FIG. 1, a preferred form of a game board 2 of the present invention is shown. The game board 2 is divided into two portions, a score portion 4 and a results portion 6. The score portion 4 includes a series of scores 8 in the form of a matrix having eight columns and eight rows. Each of the columns of scores 8 is labeled with a score column label 10 above the top of each column. The score column label 10 above the first column is Roman numeral I and each succeeding column is labeled with a score column label 10 increasing by one in Roman numerals until the last column which is labeled with a score column label 10 which is a Roman numeral VIII. There is a score hole 12 above each column in said scores 8 between the top row of said scores 8 and said score column labels 10. Each row of said scores 8 is labeled with a score row label 14. The top row of said scores 8 is labeled with a score row label 14 which is A and each succeeding row is labeled with the next letter of the alphabet with the last row being labeled with a score row label 14 which is H. The score 8 in the first row in the first column is 30 and each score 8 increases in the next succeeding column by 30. The score 8 in the second row in the first column is 50 and each score 8 increases in the next succeeding column by 50. The score 8 in the third row in the first column is 75 and each score 8 increases in the next succeeding column by 75. The score 8 in the fourth row in the first column is 100 and each score 8 increases in the next succeeding column by 100. The score 8 in the fifth row in the first column is 125 and each score 8 increases in the next succeeding column by 125. The score 8 in the sixth row in the first column is 150 and each score 8 increases in the next succeeding column by 150. The score 8 in the seventh row in the first column is 200 and each score 8 increases in the next succeeding column by 200. The score 8 in the eighth row in the first column is 250 and each score 8 increases in the next succeeding column by 250.

Still referring to FIG. 1, the results portion 4 includes a series of results 16 in the form of a matrix having five columns and eight rows. Each of the columns of results 16 is labeled with a results column label 18 above the top of each column. The results column label 18 above the first column is a representation of the side of a standard die with six dots and each succeeding column is labeled with a results column label 18 by a representation of a standard die with a decreasing number of dots until the last column which is labeled with a results column label 18 which is a representation of a standard die with two dots. There is a results hole 20 beside each row in said results 16 between the last column of said results 16 and said score row labels 14. The first column of said results 16 starts with 2 at the top and increases by 1 in each succeeding row up to 8. The second column of said results 16 starts with 3 at the top and increases by 1 in each succeeding row up to 8. The third column of said results 16 starts with 4 at the top and increases by 1 in each succeeding row up to 8. The fourth column of said results 16 starts with 5 at the top and increases by 1 in each succeeding row up to 12. The fifth column of said results 16 starts with 6 at the top and increases by 1 in each succeeding row up to 12.

Figure 2:
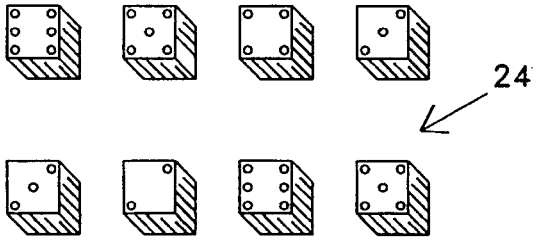
FIG. 2 is a perspective view of eight standard dice which are a portion of a preferred form of the present invention.

Referring now to FIG. 2, eight standard dice 24 are shown and provided. The dice 24 are cubes with dots numbered one through six on each of the six sides.

Figure 3:
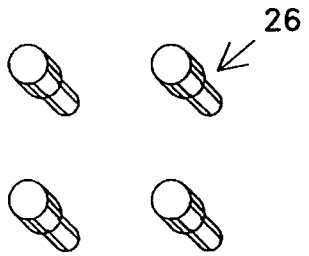
FIG. 3 is a perspective view of the colored marker pegs which are a portion of a preferred form of the present invention.

Referring now to FIG. 3, a plurality of colored marker pegs 26 are shown and provided. Each of the colored marker pegs 26 is a different color and one of said colored marker pegs 26 is white. The base of each of said colored marker pegs 26 may be removably inserted into either said score holes 12 or said results holes 20.

Figure 4:
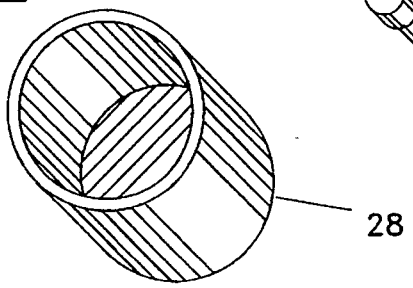
FIG. 4 is a perspective view of the dice cup which is a portion of a preferred form of the present invention.

Referring now to FIGS. 4, a dice cup 28 is shown and provided. The dice cup 28 is capable of holding at least eight of said dice 24 such that said dice 24 may be shaken and rolled in a conventional manner.

In operation the dice game and board may be used as a unique and entertaining game. The game may be played by individual players or teams of players and each player or team receives one of said colored marker pegs 26 having a different color. At the start of the game said white colored marker peg 26 is placed in said score hole 12 beneath said score column label 10 Roman numeral I. Players select a lead player or each roll a die to determine the lead player. The lead player rolls all eight of said dice 24 using said dice cup 28. If a player rolls one or more 1's they are wild and may be used to represent either a 2 or a 3 and all others of said dice 24 count at face value. The lead player may roll one, two, or three times and may reroll up to five of the eight dice on rolls after the first. The lead player's score is determined by referring to said results portion 6 of said the game board 2 and the lead player generally attempts to attain the largest number of either 6's, 5's, 4's, 3's, or 2's counting wild 1's in the fewest number of rolls. The lead player places his colored marker peg 26 in said results hole 20 corresponding to the results of his turn. If a wild 1 is used with either 2's or 3's they count double; that is, if five 2's and two 1's were rolled, the roll would be scored as nine 2's and the lead player's colored marker peg 26 would be placed in said results hole 20 beside said score row label 14 D. However, a wild 1 must be paired with either a 2 or a 3 to be counted. That is, if two 2's and four 1's were rolled, only two of the 1's could be counted; because the other two 1's are not paired. In addition at any time during his turn, the lead player may declare 4's; in which case the lead player and succeeding players may only count 4's in determining a score. Succeeding players then in turn roll the same number of times as the lead player and attempt to obtain a higher result than the lead player. A higher result is obtain by achieving a result which is in a row of said results 16 further down said results portion 6 of said game board 2 than the lead player. Each player who achieves a result higher than a previous player places his colored marker peg 26 in the appropriate results hole 20. If no succeeding player achieves a result higher than the lead player's, the lead player remains the lead player, otherwise the succeeding player achieving the highest result becomes the lead player and a new round of play begins. For example, if the lead player rolled six 6's in two rolls; he would place his colored marker peg 26 in said results hole 20 beside said score row label 14 E. The result of rolling 6's is determined by looking in said results 16 under said results column label 18 with the representation of a six and placing said colored marker 26 in said results hole 20 in the row of said results 16 showing the number of 6's rolled which is six in the example. In the example a succeeding player would have to obtain a result in two rolls which would allow him to place his colored marker peg 26 in either of said results holes 20 F, G, or H.

If the lead player achieves the highest result in a round, said white colored marker peg 26 is moved to the next higher of said score holes 12; that is, under said score column label 10 II at the start of the game. The lead player receives the score relating to the score indicated at the intersection of the column in said scoring portion 4 marked by said white colored marker peg 26 and the row marked by the lead player's colored marker peg 26. For example, if the lead player's colored marker peg 26 were in said results hole 20 beside said score row label 14 E and said white colored marker peg 26 where in said score hole 12 beneath said score column label 10 III; the lead player's score for the round would be 375. If a succeeding player has become the lead player said white colored marker peg 26 is moved back one column or remains in said score hole 12 beneath said score column label 10 I if it was already in that column and the new lead player starts a new round of play.

Only the lead player in any particular round of play may score and the lead player's scores for each round are added together. The winner of the game is the first player to achieve some predetermined total score established by the players at the start of the game.

In the preferred embodiment of the dice game and board all elements are made from tough, rigid plastic, but other materials including aluminum, wood, and the like could be used for various elements.

While preferred embodiments of this invention have been shown and described above, it will be apparent to those skilled in the art that various modifications may be made in these embodiments without departing from the spirit of the present invention. For that reason, the scope of the invention is set forth in the following claims:

I claim:

1. A method of playing a dice game for two or more players utilizing a plurality of dice and a dice cup which comprises the following steps:

(a) establishing an order of play whereby players are designated lead player, second player, and so on to the last player;

(b) initiating a first round of play by using the dice cup to throw the plurality of dice and playing in rounds beginning with the lead player and ending with the last player; each player having a turn in each round; the lead player throwing said plurality of dice one, two, or three times;

(c) establishing the number of times each player may throw the plurality of dice in each turn by determining whether the lead player threw said plurality of dice one, two, or three times;

(d) establishing the lead player's result in each round by setting a predetermined value to the number of either 6's, 5's, 4's, 3's, 2's, or 1's which the lead player rolled using said plurality of dice in either one, two, or three rolls;

(e) establishing the results of all other players in each round by determining the predetermined value of the number of either 6's, 5's, 4's, 3's, 2's, or 1's which each of the other players rolled using said plurality of dice in the same number of rolls as the lead player;

(f) determining whether the lead player achieved the highest result in any round of play; and, if the lead player achieved the highest result, the lead player is awarded a predetermined score and continues as lead player for the next round of play; and, if a player other than the lead player achieved the highest result in any round of play, that player becomes the lead player for the next round of play; and (g) continuing play in rounds an adding each player's score achieved in any round to the player's scores achieved in previous rounds until one player wins the game by achieving some predetermined score.

2. The method of playing the dice game of claim 1 in which the number of dice used is eight and in which only five or fewer dice may be rolled in any roll after the first roll.

3. The method of playing the dice game of claim 1 in which 1's are wild and may be counted the same as any other dice.

4. The method of playing the dice game of claim 3 in which 1's are wild and count as double value when paired with 2's or 3's.

5. The method of playing the dice game of claim 1 in which the lead player may call "4's" and only 4's may be used by any player in determining the predetermined value of a player's roll in that round.

6. The method of playing the dice game of claim 1 in which a game board is provided; the game board having a results section and a score section; the results section setting out the predetermined values of any player's turn and the score section setting out the lead player's predetermined score in any round.

7. The method of playing the dice game of claim 6 in which a plurality of colored markers are provided which may be placed upon the game board to indicate the predetermined values of any player's turn and the lead player's predetermined score.

* * * * *